United States Patent [19]

Kumagae et al.

[11] Patent Number: 4,466,902

[45] Date of Patent: Aug. 21, 1984

[54] RUST INHIBITOR

[75] Inventors: Shinichi Kumagae, Toyonaka; Tatsuo Manabe, Osaka, both of Japan

[73] Assignee: Ipposha Oil Industries, Co., Ltd., Osaka, Japan

[21] Appl. No.: 428,719

[22] Filed: Sep. 30, 1982

[30] Foreign Application Priority Data

Jan. 31, 1982 [JP] Japan ..... 57-13527
May 19, 1982 [JP] Japan ..... 57-85256

[51] Int. Cl.[3] ..... C23F 11/19; C23F 11/12; C23F 11/16

[52] U.S. Cl. ..... 252/391; 252/393; 252/397; 252/404; 252/407; 564/156; 106/14.13

[58] Field of Search ..... 252/393, 397, 404, 407, 252/391; 564/156; 106/14.13

[56] References Cited

U.S. PATENT DOCUMENTS 4,105,629 8/1978 Minagawa et al. ..... 252/404
4,263,167 4/1981 Mago ..... 252/393
4,364,846 12/1982 Kaufman ..... 252/393

OTHER PUBLICATIONS

Chemical Abstracts, 74, 112472q, 1971.
Lenk, *Journal of Applied Polymer Science,* vol. 15, pp. 311–315, (1971).
Chemical Abstracts 53, 19378 gh, 1959.
Chemical Abstracts 94, 161207 d.

*Primary Examiner*—Richard D. Lovering
*Assistant Examiner*—Anne Brookes
*Attorney, Agent, or Firm*—Armstrong, Nikaido, Marmelstein & Kubovcik

[57] ABSTRACT

A rust inhibitor comprising, as an effective component, at least one compound having the following general formulae (A), (B) and (C)

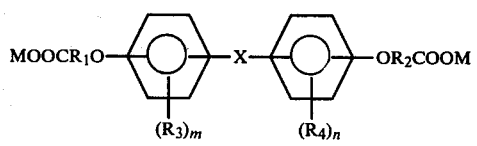

(A)

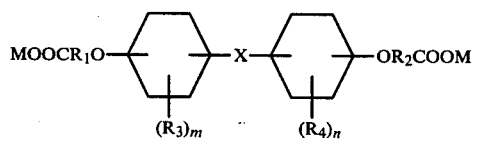

(B)

and $$MOOCR_5NHCO—Y—CONHR_6COOM \quad (C)$$

wherein $R_1$ and $R_2$ are independently a hydrocarbon group having 1 to 6 carbon atoms, $R_3$ and $R_4$ are independently a hydrocarbon group having 1 to 4 carbon atoms or a hydrocarbon group containing an aromatic ring and having 6 to 12 carbon atoms, $R_5$ and $R_6$ are independently a hydrocarbon group having 1 to 18 carbon atoms, m and n are independently 0 or an integer of 1 to 3, $R_3$ or $R_4$ is hydrogen in the case of m or n is 0, X is O, S, $SO_2$, CO or a hydrocarbon group having 1 to 9 carbon atoms, Y is an aromatic hydrocarbon group having 6 to 10 carbon atoms, and M is a cation.

This rust inhibitor has an excellent rust preventing effect for a wide variety of metals, a good stability against chemicals and oxidation and a low toxicity and is easily applicable in either a water-soluble state or an oil-soluble state.

9 Claims, No Drawings

RUST INHIBITOR

The present invention relates to a novel water-soluble and/or oil-soluble rust inhibitor. More specifically, it relates to a carboxylate type rust inhibitor having an excellent rust preventing capability for a wide variety of metals, a low toxicity and good stability, and which is easily applicable to a wide variety of metals in either a water-soluble or an oil-soluble state.

Various kinds of rust inhibitors have been heretofore developed in various application fields. However, a rust inhibitor having an excellent rust preventing capability for a wide variety of metals, a low toxicity, good stability and easy applicability has not been substantially developed.

For instance, oil-soluble type rust inhibitors such as petroleum sulfonates, alkylaryl sulfonates, oxidized waxes, sorbitan fatty acid esters, metallic soaps and other various agents have been used as a relatively long-term rust inhibitor. However, these oil-soluble type rust inhibitors involve a problem in that the removal thereof is relatively difficult when the applied rust inhibitors should be removed at a later step. Furthermore, oil-soluble type rust inhibitors involve a problem from the viewpoint of flammability, the working atmosphere and the effective usage of resources. Thus, there has been a tendency in the art that aqueous type rust inhibitors are desired. In order to solve the above-mentioned problems, an attempt has been made to use oil-soluble type rust inhibitors in the form of emulsion by dispersing or emulsifying the same in water. However, rust inhibitors having a satisfactory rust preventing effect have not been developed due to, for example, the drawbacks of emulsifying agents.

Furthermore, water-soluble compounds having an excellent rust preventing effect, for example, inorganic salts, such as, chromates, phosphates and nitrites are known in the art. However, the use of these inorganic salts has been limited from the viewpoint of pollution control, because chromates have strong toxicity, phosphates result in eutrophic waste water and nitrites, together with a lower amine, form nitrosamine, which seems to be a carcinogen.

Known water-soluble or oil-soluble organic rust inhibitors include various organic compounds such as alkyl amines, alkyl polyamines, alkylol amines, benzotriazoles, alkyl phosphate type surfactants, long-chain alkyl quaternary ammonium salts, alkyl imidazolinium salts, salts of alkylated benzoic acid and addition products of alkylene oxides and amines. These organic rust inhibitors are generally used, in combination with inorganic rust preventing salts such as sodium nitrite, because the rust preventing effect of the above-mentioned known organic rust inhibitors is not satisfactory. However, the combined use of the water-soluble organic rust inhibitor with the inorganic rust inhibitors involves a problem that the compatibility thereof is not sufficient, the stability of the rust preventing preparation containing both inhibitors is not satisfactory and the desirable rust preventing effect is lost when the rust inhibitors are continuously used. In addition, many organic rust inhibitors have surface activity and, therefore, tend to cause foaming when they are used in an aqueous medium. The foaming is a problem in a rust preventing treatment because the workability and the rust preventing effect are decreased.

Furthermore, rust preventing treatments are applied to various substances including steel and various other metals. Recently, a plurality of metals have been often subjected to simultaneous rust preventing treatments. Thus, a rust inhibitor capable of simultaneously preventing the generation of rust on many kinds of metals is often desired in the art.

The objects of the present invention are to eliminate the above-mentioned problems of the prior art and to provide an organic rust inhibitor which has an excellent rust preventing effect on steel and other metals in a small amount, without using an inorganic compound together, and which can be advantageously used, together with various conventional rust inhibitors, to exhibit an excellent rust preventing effect on steel and a plurality of various other metals.

Another object of the present invention is to provide an organic rust inhibitor having an excellent chemical stability and anit-oxidation property, a good mechanical lubricity and a low foaming property.

Other objects and advantages of the present invention will be apparent from the description set forth hereinbelow.

In accordance with the present invention, there is provided a rust inhibitor comprising, as an effective component, at least one compound having the following general formulae (A), (B) and (C):

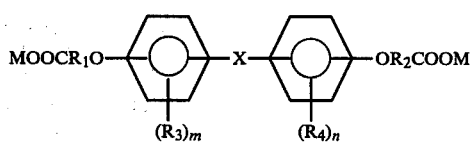

(A)

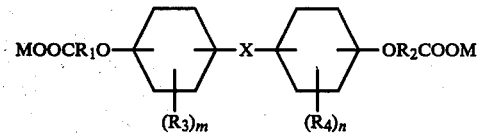

(B)

and $$MOOCR_5NHCO-Y-CONHR_6COOM \quad (C)$$

wherein $R_1$ and $R_2$ are independently a hydrocarbon group having 1 to 6 carbon atoms, $R_3$ and $R_4$ are independently a hydrocarbon group having 1 to 4 carbon atoms or a hydrocarbon group containing aromatic ring and having 6 to 12 carbon atoms, $R_5$ and $R_6$ are independently a hydrocarbon group having 1 to 18 carbon atoms, m and n are independently 0 or an integer of 1 to 3, $R_3$ or $R_4$ is hydrogen in the case of m or n is 0, X is O, S $SO_2$, CO or a hydrocarbon group having 1 to 9 carbon atoms, Y is an aromatic hydrocarbon group having 6 to 10 carbon atoms and M is a cation. The hydrocarbon groups $R_1$, $R_2$, $R_3$, $R_4$, $R_5$ and $R_6$ in the above-mentioned formulae (A), (B) and (C) may be linear or branched hydrocarbons and may contain an unsaturated bond or bonds.

Examples of the dicarboxylic acids of the dicarboxylic acid salts of the above-mentioned formulae (A), (B) and (C) are: bis(4-oxyphenyl)sulfide-o,o-dialkylcarboxylic acids such as bis(4-oxyphenyl)sulfide-o,o-dipropionic acid; bis(4-oxyphenyl)sulfone-o,o-dialkylcarboxylic acids such as bis(4-oxyphenyl)sulfone-o,o-diacetic acid and bis(4-oxyphenyl)sulfone-o,o-dipropionic acid; bis(4-oxyphenyl) ketone-o,o-dialkylcarboxylic acids such as bis(4-oxyphenyl) ketone-o,o-diacetic acid; bis(4-oxyphenyl)alkane-o,o-dialkylcarboxylic acids such as bis(4-oxyphenyl)methane-o,o-diacetic acid, β,β-bis(4-oxyphenyl)propane-o,o-diacetic acid, β,β-bis(4-oxyphenyl)propane-o,o-dipropionic acid and bis(4-oxyphenyl)methane-o,o-dibutyric acid; 2,2'-methylenebis(4-ethyl-6-tert-butylphenoxyacetic acid); 2,2'-methylenebis(4-methyl-6-tert-butylphenoxyproprionic acid); bis[(benzyl)-4-oxyphenyl]alkane-o,o-dialkylcarboxylic acids such as bis[(benzyl)-4-oxyphenyl]methane-o,o-diacetic acid; bis(4-oxycyclohexyl)alkane-o,o-dialkylcarboxylic acids such as bis(4-oxycyclohexyl)ethane-o,o-diproprionic acid; N,N'-terephthaloyldiglycine, N,N'-terephthaloyldiaminopropionic acid, N,N'-terephthaloyldiaminocaproic acid, N,N'-terephthaloyldialanine, and N,N'-terephthaloyldisarcosine.

These dicarboxylic acids may be produced by any conventional method. For instance, the dicarboxylic acids corresponding to the compounds having the above-mentioned general formula (A) can be readily produced from the corresponding diphenol compounds and halogeno carboxylic acids. The dicarboxylic acids corresponding to the compounds having the above-mentioned general formula (B) can be produced either by hydrogenating the above-mentioned dicarboxylic acids corresponding to the compounds having the general formula (A) or by reacting dicyclohexanol compounds with halogeno carboxylic acids. Furthermore, the dicarboxylic acids corresponding to the compounds having the above-mentioned general formula (C) can be readily produced by reacting o-, m- and p-phthaloyl chlorides and amino acids.

Examples of the cations in the above-mentioned general formulae (A), (B) and (C) are those derived from the reactions of the above-mentioned dicarboxylic acids and alkaline (or basic) compounds. The alkaline compounds usable in these reactions are: alkali metal salts such as sodium hydroxide, potassium hydroxide, sodium carbonate, sodium phosphate, and potassium phosphate; alkaline earth metal salts such as calcium hydroxide, and barium hydroxide; ammonia, amines such as methylamine, ethylamine, isopropylamine, trimethylamine, monoethanolamine, diethanolamine, triethanolamine, isopropanolamine, aminomethyl methanol, cyclohexylamine, and morpholine. Furthermore, various metal salts and alkylamines, other than the above-exemplified compounds, can also be used in the preparation of the above-mentioned compounds (A), (B) and (C).

The above-mentioned compounds (A), (B) and (C) can be produced by mixing the corresponding dicarboxylic acids and the alkaline compounds in a reaction solvent. The reaction mixture can optionally be heated. Any solvent which is capable of dissolving or dispersing both the components can be advantageously used. Examples of such solvents are water, organic solvents such as methanol, ethanol and methyl ethyl ketone and oils such as spindle oil and machine oil and any mixture thereof.

The dicarboxylic acids and the alkali compounds can be mixed in an equivalent amount or in a small excess of an either component. Generally speaking, the use of an excess amount of the alkaline compounds results in water-soluble rust inhibitors, whereas the use of an excess amount of the dicarboxylic acids results in oil-soluble rust inhibitors.

The rust inhibitors of the present invention can be advantageously used in the form of a solution, or a dispersion in water or oil, or in the form of an emulsion, as in the conventional rust inhibitors.

In order to use as a water-soluble type rust inhibitor, the above-mentioned compounds (A) and (B) in which $R_3$ and $R_4$ are hydrocarbon groups with a relatively small number of carbon atoms and m and n are zero or a small integer and which are produced by using an alkali metal salt, ammonia, a lower amine or a lower alkylolamine are desired. Contrary to this, in order to use as an oil-soluble type rust inhibitor, the above-mentioned compounds (A) and (B), in which $R_3$ and $R_4$ are hydrocarbon groups with a relatively large number of carbon atoms or including an aromatic ring and m and n are a relatively large integer (e.g., 2 or 3) and which are produced by using an alkaline earth metal salt or an amine having a relatively large molecular weight.

The above-mentioned dicarboxylic acid salt type compounds (A), (B) and (C) have an excellently high thermal stability and anti-oxidation stability since they contain as a basic skeleton an aromatic or alicyclic ring therein. Thus, the rust inhibitor of the present invention can be advantageously used as an effective component of a rust preventing preparation and also as a rust preventing additive for a lubricating oil, a machining oil, and a grinding oil.

Furthermore, the above-mentioned compounds (A), (B) and (C) have a lipophilic group in the center of the structure and hydrophilic groups on both sides of the lipophilic group. This specific chemical structure of the above-mentioned compounds result in an excellent orientation of the compounds on a metallic surface to be applied. Furthermore, the foaming power of the above-mentioned compounds (A), (B) and (C) is very poor, so that the present rust inhibitor has no substantial problem often caused by the foaming during a conventional rust preventing treatment and has an excellent workability.

Thus, the rust inhibitor according to the present invention has an extremely excellent rust preventing effect and exhibit a sufficient rust prevention in a small amount even without using another inorganic or organic rust inhibitor. Especially, as illustrated in Examples hereinbelow, the present rust inhibitor exhibited effective and wide range rust preventing properties both in a wet cast iron powder test and a rust preventing test of iron plates in a humidity cabinet according to a Japanese Industrial Standard (JIS) method. Most of the conventional rust inhibitors does not exhibit effective rust prevention in these tests.

The present rust inhibitor has an excellent chemical stability, anti-oxidation properties and low foaming properties, in addition to the above-mentioned excellent rust preventing effects, and, therefore, the present rust inhibitor can also be widely used, as a rust preventing additive in, for example, the following various compositions:

(1) A water-soluble rust preventing preparation for steel free from sodium nitrite;
(2) A water-soluble rust preventing preparation for various metals, used together with other water-soluble inorganic or organic rust inhibitors;
(3) A coolant;
(4) A lubricant;
(5) A water-soluble type cutting and grinding preparation;
(6) An emulsion type cutting and grinding preparation;
(7) A lubricating oil, a cutting oil, a grinding oil, a metal working oil, a milling or rolling oil, a drawing oil, a wire drawing oil, a punching oil, and an extrusion processing oil;

(8) A coating composition; and (9) A detergent composition.

The present invention will now be further illustrated by, but is by no means limited to, the following Examples, wherein all parts and percentages are expressed on a weight basis unless otherwise noted.

EXAMPLE 1

Two hundred and fifty parts of bis(4-oxyphenyl)sulfone, 96 parts of sodium hydroxide and 800 parts of water were charged into a reactor provided with a condenser and a stirrer. The mixture was dissolved upon heating.

When the temperature of the reactor content became 90° C. to 95° C., a mixed solution of 257 parts of sodium monochloroacetate and 500 parts of water was dropwise added to the reactor for 30 to 60 minutes while stirring and, then, the reaction mixture was allowed to react for 3 hours at the same temperature while stirring.

After cooling, the reaction mixture was acidified by sulfuric acid to precipitate the resultant dicarboxylic acid in the reaction mixture. The precipitated dicarboxylic acid was filtered and, then, washed with water. Thus, bis(4-oxyphenyl)sulfone-o,o-diacetic acid in the form of white powder was obtained.

Then, 100 parts of bis(4-oxyphenyl)sulfone-o,o-diacetic acid, 78 parts of triethanolamine and 415 parts of water were mixed under heating. Thus, a rust preventing composition containing, as an effective component, 30% of the triethanolamine salt of bis(4-oxyphenyl)sulfone-o,o-diacetic acid was prepared.

EXAMPLE 2

Two hundred and twenty-eight parts of β,β-bis(4-oxyphenyl)propane, 280 parts of sodium monochloroacetate, 200 parts of methanol and 300 parts of water were charged into the same reactor as used in Example 1 and the mixture was heated to a temperature of 80° C. to 85° C. while stirring to form a clear solution. A mixed solution of 105 parts of sodium hydroxide and 200 parts of water was dropwise added to the reactor for 30 to 60 minutes at the same temperature while stirring and, then, the mixture was allowed to react for 3 hours at the same temperature while stirring.

After cooling, the reaction mixture was acidified with sulfuric acid to precipitate the resultant dicarboxylic acid, followed by filtration and water washing. Thus, 317 parts of β,β-bis(4-oxyphenyl)propane-o,o-diacetic acid in the form of white powder was obtained.

The resultant β,β-bis(4-oxyphenyl)propane-o,o-diacetic acid was converted into the triethanolamine salt and a rust preventing composition containing 30% of the effective component was prepared in the same manner as in Example 1.

EXAMPLE 3

Bis(4-oxyphenyl)methane-o,o-dipropionic acid was obtained from 198 parts of bis(4-oxyphenyl)methane, 192 parts of sodium hydroxide, 980 parts of water and 220 parts of monochloropropionic acid in the same manner as in Example 1. The resultant bis(4-oxyphenyl)-o,o-dipropionic acid was neutralized with triethanolamine in a manner as described in Example 1 to convert it into the triethanolamine salt and a rust preventing composition containing 30% of the effective component was prepared in the same manner as in Example 1.

Various salts of bis(4-oxyphenyl)-o,o-dipropionic acid listed in Table 3 below were prepared in the same manner as in Example 1 and rust preventing compositions containing 30% of the effective components were prepared from the resultant salts.

EXAMPLE 4

Triethanolamine salt of 2,2'-methylenebis(4-ethyl-6-tert-butylphenoxyacetic acid) was prepared from 2,2'-methylenebis(4-ethyl-6-tert-butyl phenol) and sodium monochloroacetate in the same manner as in Example 1. The results are shown in Table 3.

EXAMPLE 5

β,β-Bis[(benzyl)-4-oxyphenyl]propane-o,o-diacetic acid was prepared from β,β-bis[(benzyl)-4-oxyphenyl]-propane and sodium monochloroacetate and was converted into the triethanolamine salt in the same manner as in Example 1. A rust preventing composition containing 30% of the effective component was prepared in the same manner as in Example 1.

EXAMPLE 6

Bis(4-cyclohexyl)ethane-o,o-dipropionic acid was prepared from bis(4-oxycyclohexyl)ethane and monochloropropionic acid and was converted into the triethanolamine salt in the same manner as in Example 3. A rust preventing composition containing 30% of the effective component was prepared in the same manner as in Example 3.

EXAMPLE 7

One hundred parts of 2,2'-methylenebis(4-ethyl-6-tert-butylphenoxyacetic acid obtained in Example 4 was mixed with 16 parts of calcium hydroxide (an equivalent ratio was 1:1.05) and the mixture was heated to a temperature of 150° C. to 160° C. for 3 hours while stirring. The resultant mixture was cooled to a temperature of 110° C. and, then, 2185 parts of a spindle oil was added to the mixture. After allowing the mixture to cool, the unreacted calcium was removed from the mixture by decantation to obtain an oil-soluble type rust preventing composition containing 5% of the calcium salt.

Oil-soluble type rust preventing compositions containing the magnesium salt and the barium salts were also prepared in the same manner as in the calcium salt.

These oil-soluble type rust preventing compositions were diluted twice by the spindle oil and kerosine prior to the evaluation of the rust preventing compositions set forth hereinbelow.

Comparative Example 1

One hundred parts of benzoic acid, 117 parts of triethanolamine and 506 parts of water were stirred under heating. Thus, an aqueous composition containing 30% of the triethanolamine salt of benzoic acid was obtained.

This is a sample of a conventional water-soluble type rust inhibitor component.

Comparative Example 2

One hundred parts of oleic acid, 51 parts of triethanol and 352 parts of water were stirred under heating. Thus, a rust preventing composition containing 30% of the triethanolamine salt of oleic acid was obtained.

Comparative Example 3

One hundred parts of sebacic acid, 160 parts of triethanolamine and 615 parts of water were mixed while stirring to prepare a rust inhibitor composition containing about 30% of the effective component. This is a sample of a conventional water-soluble type rust preventing composition having a characteristic low foaming property.

Comparative Example 4

Thirty parts of the triethanolamine salt of oleylsarcosine, 30 parts of butylcellosolve and 40 parts of water were mixed to prepare a water-soluble type rust preventing composition.

Comparative Example 5

Twenty parts of the triethanolamine salt of alkylphosphoric acid ester, 3 parts of sodium benzoate, 7 parts of sodium nitrite and 70 parts of water were mixed to prepare a water-soluble type rust preventing composition in which an organic compound was used in combination with an inorganic compound.

The rust preventing compositions prepared in Examples 1 to 7 and Comparative Examples 1 to 5 were evaluated by the following test methods. The results are shown in Tables 1 to 4 below.

<Test Methods>

(1) Evaluation test of rust preventing property under humidity conditions

The evaluation was carried out according to a JIS-K-2246 method. SPCC-1 steel test panels were dipped in a test composition (i.e., 1% aqueous solutions of the water-soluble rust inhibitors or oil-soluble rust inhibitor compositions having the given concentration) and was, then, air dried. The rusting of the steel panels was tested in a humidity cabinet under the conditions of a temperature of 49±1° C., R.H. (relative humidity) of more than 95% and an air feed amount of 886.5±110.5 liter/hour.

The evaluation of the rust generation was made according to a JIS-K-2246 method and based on the following classification.

A: No rusting
B: Less than 10% rusting generation
C: Less than 25% rusting
D: Less than 50% rusting
E: More than 50% rusting (2) Foaming test The evaluation was carried out according to a so-called Ross-clark method. 200 ml of a 1% aqueous solution of a sample was charged into a cylinder having an inner diameter of 50 mm and a height of 1000 mm while maintaining a sample temperature to 20±1° C. Air is continuously blown into the sample at a feed rate of 500 ml/min through a glass filter provided at the bottom of the cylinder and having a pore diameter of 40 to 50 microns. The height of the foam thus formed was measured after 60 seconds.

(3) Cutting powder test

Five grams of dry cut wastage of cast iron (FC-20 and FC-25) was washed in hot toluene and, then, washed with methanol. The cutting wastage was dipped at an ambient temperature for 1 minute in an aqueous test sample solution containing 1% of the effective component and having a pH of 9.5 (adjusted by sodium hydroxide). The cutting wastage was shaken free of the liquid and was placed on a filter paper in a Petri dish having a diameter of 60 mm. Then, 1 ml of the test sample solution was placed in the Petri dish. The Petri dish was covered and was allowed to stand under the conditions of a temperature of 30±1° C. and an R.H. of 80%. The rusting time and the rusting rating according to a JIS-K-2246 method after 24 hours were measured.

(4) Dipping test

Dry cut wastage of cast iron (FC-25) was washed in the same manner as in the above cutting powder test and was, then, dipped in aqueous test sample solutions containing 0.5% and 1.0% of the effective component and having a pH of 9.5 (adjusted by sodium hydroxide). Thus, the period (in days) before which rusting occurred was measured.

(5) Room exposure test

SPCC-1 steel test panels subjected to the same rust preventing treatment as in the above-mentioned evaluation test of rust preventing property under humidity conditions were allowed to stand at an ambient temperature in a room. The period in days before which rusting occurred was measured.

(6) Match test

SPCC-1 steel and FC-20 cast iron test pieces were polished with No. 240 Emery paper and were washed with the solvents as in the above-mentioned cutting powder test. One drop of an aqueous test sample solution containing 0.25% of the effective component was placed on the surface of the test piece and, then, another test piece was laid thereover. The sandwitch type assembly thus formed was allowed to stand for 24 hours under the conditions of a temperature of 30±1° C. and R.H. of 80%. The rusting of the sandwitched surfaces was visually observed.

o . . . No rusting
Δ . . . Partial rusting
x . . . More than 30% rusting (7) Non-ferrous metal corrosion test Dipping corrosion test was carried out according to a JIS-K-2246 method. Test pieces were polished with no. 240 Emery paper and was washed in hot toluene and, then, washed with methanol. The test pieces were dipped in an aqueous test sample solution containing 1% of the effective component at a temperature of 55±1° C. for 7 days. The visual changes in the metal surface and the test sample solution were observed. The corrosion rate (mg/cm$^2$) was obtained by determining the loss in weight before and after the dipping.

(8) Salt water spray test

This test was carried out according to JIS-K-2246 and JIS-Z-2371 methods. The test sample treated in the same manner as in the above-mentioned test method 1) was sprayed with a 5% aqueous sodium chloride solution at 35° C. for the predetermined time by means of the specified salt water spray apparatus. The rusting degree was determined as follows.

A . . . No rusting
B . . . Less than 10% rusting
C . . . Less than 25% rusting
D . . . Less than 50% rusting
E . . . More than 50% rusting

TABLE 1

| Item / Condition / Sample | Humidity Test: 5 hr Later | 10 | 15 | 20 | 25 | 30 | 35 | 40 | Foaming Test mm | Cutting Powder Test FC-20: Rusting Time (Hr) | FC-20 Rusting | FC-25: Rusting Time (Hr) | FC-25 Rusting | Dipping Test Rusting Days 0.5% | 1.0% | Room Exposure Test Rusting Days |
|---|---|---|---|---|---|---|---|---|---|---|---|---|---|---|---|---|
| Example 1 | A | A | A | A | A | B | B | B | 5 | >24 | A | >24 | A | >20 | >20 | >30 |
| Example 2 | A | A | A | A | A | A | A | A | 5 | >24 | A | >24 | A | >20 | >20 | >30 |
| Example 3 | A | A | A | A | A | A | A | B | 5 | >24 | A | >24 | A | >20 | >20 | >30 |
| Comparative Example 1 | A | B | E | E | — | — | — | — | 5 | 0.5 | E | 0.5 | E | 3 | 15 | 10 |
| Comparative Example 2 | A | A | B | B | C | D | E | — | 250 | 0.2 | E | 0.2 | E | 2 | 10 | 7 |
| Comparative Example 3 | A | A | A | A | A | B | B | B | 5 | 0.5 | D | 0.5 | C | 3 | >20 | 14 |
| Comparative Example 4 | A | B | E | E | — | — | — | — | 110 | 0.2 | E | 0.2 | E | 2 | 12 | 7 |
| Comparative Example 5 | A | A | A | B | B | C | D | E | 180 | 0.2 | E | 0.2 | D | 3 | 15 | >30 |

TABLE 2

| Item / Condition / Sample | Match Test: Cast iron / Cast iron | Steel / Steel | Steel / Cast iron | Non-ferrous Corrosion Test: Copper: Metal surface | Copper: Liquid observation | Copper: Corrosion rate | Zinc: Metal surface | Zinc: Liquid observation | Zinc: Corrosion rate | Brass: Metal surface | Brass: Liquid observation | Brass: Corrosion rate | Aluminum: Metal surface | Aluminum: Liquid observation | Aluminum: Corrosion rate |
|---|---|---|---|---|---|---|---|---|---|---|---|---|---|---|---|
| Example 1 | Δ | o | Δ | No change | Slightly bluish | −0.113 | Partially slight greyish | No change | −0.094 | Partially slight discoloring | Slightly bluish | −0.101 | No change | No change | −0.004 |
| Example 2 | Δ | o | Δ | No change | Slightly bluish | −0.103 | Partially slight greyish | No change | −0.099 | Partially slight discoloring | Slightly bluish | −0.103 | No change | No change | −0.003 |
| Example 3 | Δ | o | Δ | No change | Slightly bluish | −0.112 | Partially slight greyish | No change | −0.085 | Partially slight discoloring | Slightly bluish | −0.098 | No change | No change | −0.004 |
| Comparative Example 1 | Δ | Δ | Δ | | | | | | | | | | | | |
| Comparative Example 2 | x | x | x | | | | | | | | | | | | |
| Comparative Example 3 | x | Δ | x | | | | | | | | | | | | |
| Comparative Example 4 | x | x | x | | | | | | | | | | | | |
| Comparative Example 5 | Δ | o | x | | | | | | | | | | | | |

TABLE 3

| Sample | Item Kind of salt | Humidity Test: 5 Hr Later | 10 | 15 | 20 | 25 | 30 | 35 | 40 | Foaming Test mm |
|---|---|---|---|---|---|---|---|---|---|---|
| Example 3 | Na | A | A | A | A | A | A | B | B | 5 |
| " | K | A | A | A | A | A | A | B | B | 5 |
| " | $NH_4$ | A | A | A | A | A | B | B | C | 5 |
| " | Methylamine | A | A | A | A | A | A | B | B | 5 |
| " | Monoethanolamine | A | A | A | A | A | A | B | B | 6 |
| " | Diethanolamine | A | A | A | A | A | A | A | B | 5 |
| " | Cyclohexylamine | A | A | A | A | A | A | B | B | 5 |

TABLE 3-continued

| Sample | Item Kind of salt | Humidity Test 5 Hr Later | 10 | 15 | 20 | 25 | 30 | 35 | 40 | Foaming Test mm |
|---|---|---|---|---|---|---|---|---|---|---|
| " | Morpholine | A | A | A | A | A | A | B | B | 6 |
| Example 4 | Triethanolamine | A | A | A | A | B | B | B | C | 5 |
| Example 5 | " | A | B | E | E | — | — | — | — | 6 |
| Example 6 | " | A | A | B | B | C | E | E | — | 5 |

TABLE 4

| Sample | Kind of Salt | Humidity Test Spindle oil 15 Day | Spindle oil 30 Day | Kerosine 15 Day | Kerosine 30 Day | Salt Water Spray Test Spindle oil 3 Hr | Spindle oil 6 Day | Spindle oil 24 Day | Kerosine 3 Day | Kerosine 6 Day | Kerosine 24 Day |
|---|---|---|---|---|---|---|---|---|---|---|---|
| Example 7 | Ca | A | A | A | A | A | A | B | A | A | B |
| " | Mg | A | A | A | A | A | B | E | A | B | E |
| " | Ba | A | A | A | A | A | A | B | A | A | B |
| No addition | — | C | E | C | E | E | E | E | E | E | E |

EXAMPLE 8

Forty three parts of aminocaproic acid, 25 parts of sodium hydroxide and 140 parts of water were charged into a reaction vessel provided with a condenser and a stirrer. The mixture was stirred and a solution of 30 parts of terephthaloyl chloride dissolved in 70 parts of dioxane was dropwise added thereto while cooling so as to maintain the temperature of the reaction mixture at 30° C. or less. After the completion of the dropwise addition, the reaction mixture was stirred for 3 hours at a temperature of 30° C. and, then, was neutralized with sulfuric acid while cooling.

The white precipitate thus formed was filtered and was washed with water. Then, the precipitate was purified in isopropyl alcohol to obtain N,N'-terephthaloyl diaminocaproic acid.

Thirty parts of N,N'-terephthaloyl diaminocaproic acid obtained above was mixed with 26 parts of triethanolamine and 132 parts of water under heating to prepare a rust preventing composition containing about 30% of the effective component.

EXAMPLE 9

Fifteen parts of N,N'-terephthaloyl diaminocaproic acid obtained in Example 8 was mixed with 3 parts of sodium hydroxide and 42 parts of water under heating to prepare a rust preventing composition containing about 30% of the effective component.

EXAMPLE 10

Fifteen parts of N,N'-terephthaloyl diaminocaproic acid obtained in Example 8 was mixed with 4.5 parts of potassium hydroxide and 45.5 parts of water under heating to prepare a rust preventing composition containing about 30% of the effective component.

EXAMPLE 11

Fifteen parts of N,N'-terephthaloyl diaminocaproic acid obtained in Example 8 was mixed with 8 parts of diethanolamine and 54 parts of water under heating to prepare a rust preventing composition containing about 30% of the effective component.

EXAMPLE 12

Fifteen parts of N,N'-terephthaloyl diaminocaproic acid obtained in Example 8 was mixed with 4 parts of methylamine and 44 parts of water under heating to prepare a rust preventing composition containing about 30% of the effective component.

EXAMPLE 13

Fifteen parts of N,N'-terephthaloyl diaminocaproic acid obtained in Example 8 was mixed with 5 parts of monoethanolamine and 47 parts of water under heating to prepare a rust preventing composition containing about 30% of the effective component.

EXAMPLE 14

Fifteen parts of N,N'-terephthaloyl diaminocaproic acid obtained in Example 8 was mixed with 7 parts of cyclohexylamine and 51 parts of water to prepare a rust preventing composition containing about 30% of the effective component.

EXAMPLE 15

One hundred and sixty five parts of glycine, 176 parts of sodium hydroxide and 511 parts of water were charged into the same reaction vessel as used in Example 8 and mixed while stirring. To this mixture, a solution of 396 parts of terephthaloyl chloride dissolved in 800 parts of dioxane was dropwise added for 30 to 60 minutes while cooling so as to maintain the temperature of the reaction mixture at 30° C. or less. After completing the dropwise addition, the reaction mixture was further stirred for 2 hour at a temperature of 30° C. to 40° C. and, then, was neutralized with sulfuric acid to precipitate the resultant dicarboxylic acid.

The precipitate thus formed was filtered and was washed with water to obtain N,N'-terephthaloyl diglycine in the form of white powder.

Fifty parts of N,N'-terephthaloyl diglycine was mixed with 60 parts of triethanolamine and 257 parts of water while stirring to prepare a rust preventing composition containing 30% of the effective component.

EXAMPLE 16

Eighty nine parts of DL-alanine, 50 parts of sodium hydroxide and 200 parts of water were charged into the same reaction vessel as used in Example 8 and mixed while stirring. To this mixture, a solution of 95 parts of phthaloyl chloride dissolved in 100 parts of dioxane was dropwise added so as to maintain the temperature of the reaction mixture at 30° C. or less. After completing the dropwise addition, the reaction mixture was further stirred for 2 hours at a temperature of 30° C. to 40° C.

and, then, was neutralized with sulfuric acid to precipitate the resultant dicarboxylic acid.

The dicarboxylic acid was filtered and washed with water. Thus, N,N'-phthaloylbis(DL-alanine) in the form of white powder was obtained.

Thirty parts of N,N'-phthaloylbis(DL-alanine) was mixed with 45 parts of triethanolamine and 175 parts water to prepare a rust preventing composition containing about 30% of the effective component.

Comparative Example 6

One hundred parts of benzoic acid, 117 parts of triethanolamine and 506 parts of water were mixed under heating while stirring to obtain a rust preventing composition containing about 30% of the effective component.

Comparative Example 7

One hundred parts of oleic acid, 51 parts of triethanolamine and 352 parts of water were mixed under heating while stirring to obtain a rust preventing composition containing about 30% of the effective component.

The rust preventing compositions prepared in Examples 8 to 16 and Comparative Examples 6 and 7 were evaluated. The results are shown in Tables 5 and 6. Table 5 shows the results of the rusting test according to a JIS-K-2246 method mentioned above and the foaming test mentioned above. Table 6 shows the results of the rusting test according to a JIS-K-2246 method mentioned above, in which correlations between the rusting time and the rusting rating are shown.

TABLE 5

| Sample | Rusting Rating 5 Hr Later | 10 Later | 15 Later | 20 Later | 25 Later | 30 Later | 35 Later | 40 Later | Foaming (mm) |
|---|---|---|---|---|---|---|---|---|---|
| Example 8 | A | A | A | A | A | A | A | A | 5 |
| Example 9 | A | A | A | A | A | A | B | B | 6 |
| Example 10 | A | A | A | A | A | A | B | B | 5 |
| Example 11 | A | A | A | A | B | B | C | C | 5 |
| Example 12 | A | A | A | A | A | B | B | C | 5 |
| Example 13 | A | A | A | A | A | B | B | C | 6 |
| Example 14 | A | A | A | A | A | B | B | C | 6 |
| Example 15 | A | A | A | A | A | A | A | B | 5 |
| Example 16 | A | A | A | A | A | B | B | B | 5 |
| Comparative Example 6 | A | B | B | E | E | E | E | E | 7 |
| Comparative Example 7 | A | A | B | C | D | D | E | E | 250 |

TABLE 6

| Sample | FC-20 Rusting Time (H) | FC-20 Rusting Rating | FC-25 Rusting Time (H) | FC-25 Rusting Rating |
|---|---|---|---|---|
| Example 8 | >24 | A | >24 | A |
| Example 9 | 20 | B | >24 | A |
| Example 10 | 20 | B | 20 | B |
| Example 11 | 20 | B | >24 | A |
| Example 12 | 15 | C | 20 | B |
| Example 13 | >24 | A | >24 | A |
| Example 14 | >24 | A | >24 | A |
| Example 15 | 20 | B | 20 | B |
| Example 16 | >24 | A | >24 | A |
| Comparative Example 6 | 0.5 | E | 0.5 | E |
| Comparative Example 7 | 0.5 | E | 0.5 | E |

The results shown in Tables 1 to 6 clearly indicate the following advantages of the present invention.

(1) The rust inhibitors of the present invention exhibited excellent rust preventing properties equal to, or superior to, those of the known rust inhibitors having an excellent rust preventing property and the rust preventing composition containing a known typical rust preventing compound, sodium nitrite.

(2) The rust inhibitors of the present invention have a poor foaming property, in addition to excellent rust preventing properties, and, therefore, are readily applicable to metals without causing a decrease in the rust preventing properties caused by foaming.

(3) The rust inhibitors of the present invention exhibited excellent rust preventing properties and effects all in the humidity test, the cutting powder test, the dipping test, the room exposure test, the match test and the salt water spray test. Contrary to this, the comparative rust inhibitors did not necessarily exhibit good results in all the above-mentioned tests. This means that the rust inhibitors of the present invention can be usefully applied to any substrates used under various conditions.

(4) The rust inhibitors of the present invention exhibited excellent rust preventing properties, even without using inorganic salt type rust inhibitors such as sodium nitrite, as different from conventional organic type rust inhibitors.

(5) The rust inhibitors of the present invention have excellent rust preventing properties not depending upon the kinds of the compounds, although some changes in the rust preventing properties were observed.

(6) The water-soluble type rust inhibitors of the present invention can be readily removed from the substrates by washing with water. Thus, the post-treatment is easy and there is no adverse effect in the post-treatment step.

(7) The rust inhibitors of the present invention caused no substantial or little corrosion against non-ferrous metals. Thus, no substantial corrosion problem occurs when the rust inhibitor of the present invention is applied to non-ferrous metals. The results similar to those shown in Table 2 were obtained in the other non-ferrous metals. Especially when the present rust inhibitors in the form of sodium salt were used, no corrosion on the metal surfaces and no visual changes in the test solutions were observed. It should be noted, however, that the combined use of another type of rust inhibitor or agents together with the present rust inhibitors may be advantageous to effect a perfect corrosion resistance of non-ferrous metals.

(8) The present rust inhibitors in the form of polyvalent metal salts were oil-soluble type rust preventing components and exhibited good rust preventing properties even in the case of the humidity test and the salt water spray test.

We claim:

1. A method for inhibiting rust on a metal which comprises:

treating the metal with a rust inhibitor comprising, as an effective component, at least one compound having the following general formulae (A), (B), and (C)

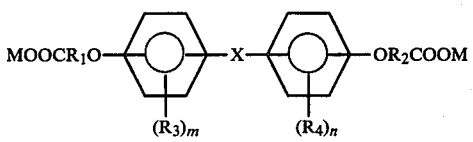

(A)

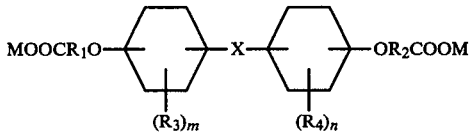

(B)

and $$MOOCR_5NHCO—Y—CONHR_6COOM \quad (C)$$

wherein $R_1$ and $R_2$ are independently a hydrocarbon group having 1 to 6 carbon atoms, $R_3$ and $R_4$ are independently a hydrocarbon group having 1 to 4 carbon atoms or a hydrocarbon group containing an aromatic ring and having 6 to 12 carbon atoms, $R_5$ and $R_6$ are independently a hydrocarbon group having 1 to 18 carbon atoms, m and n are independently 0 or an integer of 1 to 3, $R_3$ or $R_4$ being hydrogen in the case of m or n being 0, X is O, S, $SO_2$, CO or a hydrocarbon having 1 to 9 carbon atoms, Y is an aromatic hydrocarbon group having 6 to 10 carbon atoms and M is a cation, said rust inhibitor being in the form of a solution, a dispersion, or an emulsion.

2. A method as claimed in claim 1, wherein said compound has the general formula (A).

3. A method as claimed in claim 2, wherein $R_1$ and $R_2$ are independently a hydrocarbon group having 1 to 3 carbon atoms in the general formula (A).

4. A method as claimed in claim 2, wherein $R_3$ and $R_4$ are independently hydrogen or a methyl group in the general formula (A).

5. A method as claimed in claim 2, wherein X is O, $SO_2$, or a hydrocarbon group having 1 to 4 carbon atoms in the general formula (A).

6. A rust inhibitor as claimed in claim 1, wherein said compound has the general formula (B).

7. A rust inhibitor as claimed in claim 1, wherein said compound has the general formula (C).

8. A method as claimed in claim 1, wherein said compound has the general formula (A) wherein $R_1$ and $R_2$ are independently a hydrocarbon group having 1 to 3 carbon atoms, $R_3$ and $R_4$ are hydrogen or a methyl group, and X is O, $SO_2$, or a hydrocarbon group having 1 to 4 carbon atoms.

9. A rust inhibitor as claimed in claim 1, wherein said compound has the general formula (B) wherein $R_1$ and $R_2$ are independently a hydrocarbon group having 1 to 3 carbon atoms, $R_3$ and $R_4$ are hydrogen or a methyl group, and X is O, $SO_2$, or a hydrocarbon group having 1 to 4 carbon atoms.

* * * * *